United States Patent [19]

Miyazaki

[11] Patent Number: 4,864,793

[45] Date of Patent: Sep. 12, 1989

[54] SLATE AND METHOD OF MANUFACTURING THEREFOR

[75] Inventor: Hiroshi Miyazaki, Wakayama, Japan

[73] Assignee: Kabushiki Kaisha Alps Slate, Arita, Japan

[21] Appl. No.: 27,469

[22] Filed: Mar. 18, 1987

[30] Foreign Application Priority Data

Mar. 18, 1986 [JP] Japan ..... 61-61736
Apr. 8, 1986 [JP] Japan ..... 61-53334

[51] Int. Cl.[4] ..... E04D 1/00
[52] U.S. Cl. ..... 52/54; 52/316
[58] Field of Search ..... 52/554, 555, 560, 316

[56] References Cited

U.S. PATENT DOCUMENTS

| | | | |
|---|---|---|---|
| 1,473,253 | 11/1923 | Reynolds | 52/560 |
| 1,945,004 | 1/1934 | McQuade | 52/316 X |
| 2,133,854 | 10/1938 | Fischer | 52/560 |
| 2,170,534 | 8/1939 | MacNutt | 52/316 |
| 2,200,341 | 5/1940 | Rahr | 52/316 |
| 2,513,972 | 7/1950 | Stitt | 52/316 X |
| 3,091,898 | 6/1963 | Fasold et al. | 52/554 X |
| 3,616,103 | 10/1971 | Greiner | 52/316 X |
| 4,262,466 | 4/1981 | Roe | 52/554 X |

*Primary Examiner*—Carl D. Friedman
*Attorney, Agent, or Firm*—Edwin E. Greigg

[57] ABSTRACT

A slate and the method of manufacturing therefor comprising substantially a single color mortar cement. The outer surface of the slate has at least two different shapes which produce a different color variation to one another.

10 Claims, 2 Drawing Sheets

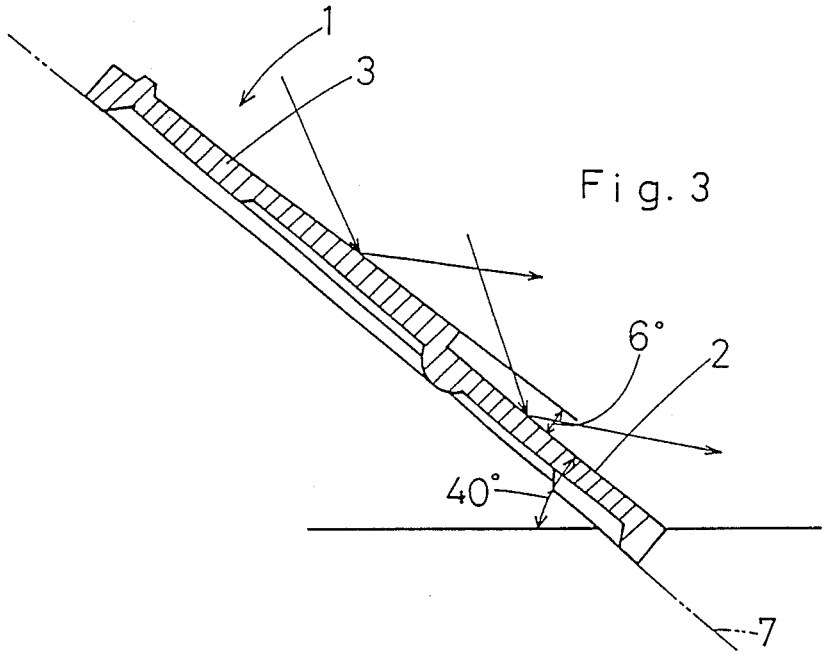
Fig. 3
Fig. 4
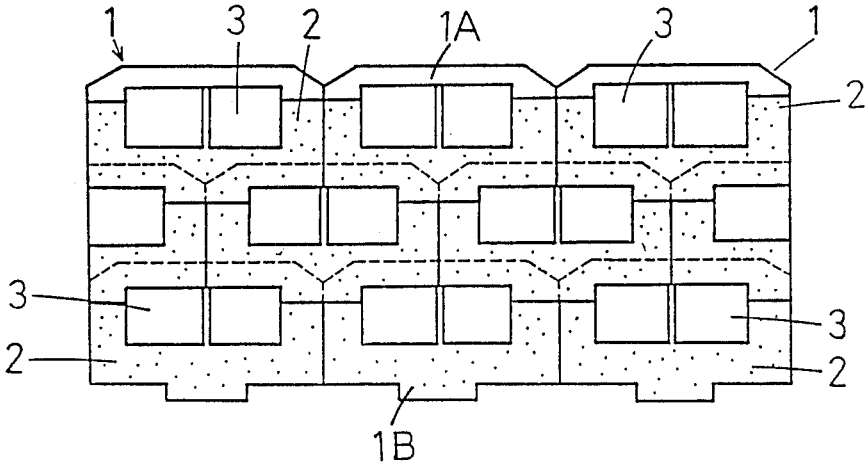

SLATE AND METHOD OF MANUFACTURING THEREFOR

BACKGROUND OF THE INVENTION

This invention relates to a slate which may be used as a roofing slate, a tile or a panel for a wall, and also relates to a method of manufacturing therefor.

Conventionally, to give a pattern to a roof or a wall of a house, different colors of tiles or slates are combined.

According to this conventional method, it is necessary to prepare a number of tiles or slates which are different from each other in color. This method, therefore, brings about such a disadvantage that it necessitates different colors of paints and a plurality of metal molds which rise the manufacturing cost of the slate.

Therefore, it is desired such a slate and a method of manufacturing same which may give a pattern to a roof or a wall while minimizing a number of metal molds for manufacturing the slates.

The inventor has researched to be able to give a variation in color and pattern in spite of slating a house with a kind of slates on the assumption that it is used such a low-cost mortar slate of substantially a single color which may be easily molded by using a single colored mortar or which may be obtained easily by spraying a single color paint to a mold slate.

The inventor has paid attention to that a pattern or a color is determined by the wave length of a light which a viewer actually meets. It has been assumed that there would be a way of giving the viewer variation in pattern and color in case that reflecting conditions of a light on the slate are different partially, even if slates of single colored mortar are used other than using different colored slates.

SUMMARY OF THE INVENTION

An object of this invention is to obtain different colors and/or different pattern in spite of using slates of substantially a single colored mortar cement or a single color paint.

To achieve the first object, a slate of mortar cement having substantially a single color according to this invention comprises an outer surface with a first part having one shape and a second outer surface part having a shape different from the said first outer surface part for giving therebetween a color variation.

Therefore, since the outer surface of the slate is shaped to make a color variation, when the slate is, for example, used for a roof, the wave length of a light reflected upon the outer surface part is different from that of the light reflected upon the second outer surface part. Therefore, in spite of using the slates of single color, a variation in color or pattern can be obtained by arranging the slates in a desired pattern.

Another object of this invention is to give a color variation to a slate by forming inclined surface portions of different angles on the outer surface of the slate in spite of using a single color mortar cement or a single color paint.

Where such slates are used as a roof, a viewer on the ground sees the color of the slates, but actually receives the reflected wave lengths of the light which are affected by the inclined outer surfaces of different angles.

Namely, the viewer sees the color of the slate as a mixed color of that of the light reflected upon a standard surface and that of the light reflected upon the inclined surface. In carrying out the teaching of this invention, a standard surface is one which is parallel with the surface upon which the slate is to be mounted, and the inclined surface is sloped to have an angle relative to the surface upon which the slate is mounted and the standard surface. Thus, the viewer sees the slates with the color different from the original color thereof by the reason that the standard surface and the inclined surface reflect the light with different wave lengths though all of the outer surface of the slate is colored with a single color.

Accordingly, it may desirably obtain a variation in pattern and/or color by disposing the slates to take such positions that the standard surface and the inclined surface may form a desired pattern.

The color variation referred to in this invention is limited to a range of color variation which depends on intensity of the rays of the sun or the artificial light source and an angle of incidence to the slate. However, a number of color variations has been obtained in experiment more than the inventor expected.

The third object of this invention is to provide a method of manufacturing the above-mentioned slate.

The method of manufacturing the slate comprises the steps of combining at least two metal molds, molding a single color mortar cement into the metal molds, and forming an inclined surface portion or an irregular surface portion by means of press forming process.

In the course of the slate manufacturing, it has an advantage that combination of the metal molds can be varied so as to unlimitedly increase variations in color and pattern. Further, since it is possible to use many basic colors for the mortar cement, desired color patterns can be obtained easily.

Other objects and advantages of this invention will be apparent from the following description.

BRIEF DESCRIPTION OF THE DRAWINGS

The drawings show an embodiment of a slate according to this invention in which:

FIG. 3 is an enlarged sectional view taken along lines III—III in FIG. 1, and

FIG. 4 is a front view showing a state of use of a number of the slates.

DETAILED DESCRIPTION OF THE PREFERRED EMBODIMENT

Figure 1:
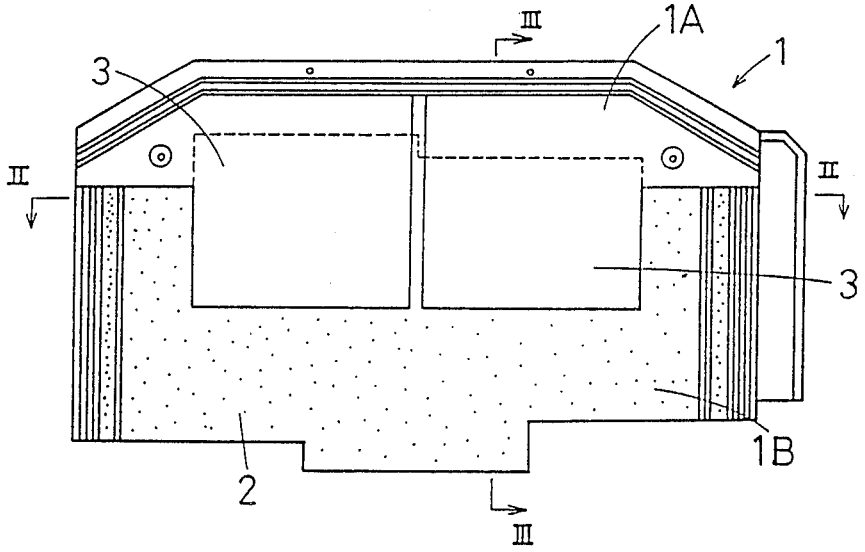
FIG. 1 is a front view of the whole slate.
Figure 2:
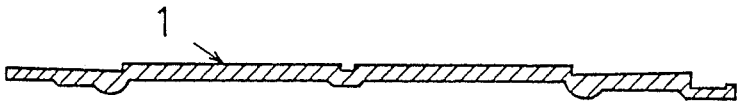
FIG. 2 is a sectional view taken along lines II—II in FIG. 1.

As shown in FIG. 1 through FIG. 3, 1 is a slate which is manufactured by filling a mortar cement of single color such as green in metal molds (not shown) and by pressing same so as to form a standard outer surface portion 2, that is, the portion 2 has a constant thickness over its length and width and an inclined surface portion 3, which portion 3 relative to the outer surface portion 2 is inclined from an upper end 1A of the slate 1 to a bottom end 1B thereof at an angle of about 6 degrees to the standard surface portion 2. It is of course possible to spray a green paint to the slate after forming thereof. Thus, the slate is constructed such that the reflecting angles of the light upon the standard surface 2 and the inclined surface 3 become 30 degrees and 36 degrees respectively to a viewer on the ground when an angle of incidence to the slate is 30 degrees to the horizontal, in the event that the slate is fixed on a roof having an angle of inclination of about 40 degrees, as shown in FIG. 3.

It is preferable to use the angle of the inclined surface portion in the range of one to 10 degrees other than the above-mentioned 6 degrees, but it may be possible to use the other angles. The upper end 3A of the inclined surface portion 3 takes substantially the same level as the standard surface portion SB.

The bottom end SB of the inclined surface portion 3 is located at a middle portion between the upper and lower portions of the slate 1. The standard surface portion 2 is formed aventurine or rough and the inclined surface portion S is formed even or flat so as to increase color variations by utilizing intensity of reflection of the light due to interference of the light with the rough surface portion 2. To this end, the interior wall of the metal mold which forms the standard surface portion 2 of the outer surface of the slate 1, is made rough and that of the metal mold for the inclined surface portion 3 is finished flat. The metal molds referred to in this invention is made of not only metal but also wood or plastics.

FIG. 4 shows an example of the arrangement of the slates for slating a roof.

Improvements of this invention may be cited as follows:

It is possible to form the standard surface portion 2 to be aventuring by means of embossment other than forming of the uneven or rough surface portion.

It is also possible to arrange the standard surface 2 and the inclined surface S to disperse at plural positions of the single slate 1.

In case that a color paint is sprayed on a single slate 1, it is of course possible to achieve the object of this invention even if plural color paints are used as far as the idea of this invention is utilized.

It is preferable to arrange normal slates and the slates of this invention desirably so as to make many kinds of patterns.

To achieve the object of this invention, the following modification can be made.

Instead of the inclined surface of the slate, a part of the outer surface of the slate is formed to have a brilliant spangled appearance of aventurin and the other part is formed flat and smooth, so that a color variation can be obtained by strength and weakness of reflection of the light occurred by interference on the surface having a brilliant spangled appearance of aventurin. To manufacture the slate, the interior wall surface of a metal mold (not shown) which forms the part of the outer surface of the slate, is made rough or to have a brilliant spangled appearance of aventurin and the interior wall surface of the other metal mold (not shown) is finished flat and smoothly. The mold used in this invention may be made by not only metal but also wood, plastics and the like. These molds are assembled and the mortar cement of single color 4 is injected therein so as to manufacture the slate 1. Where these slates 1 are arranged as roof slates, a pattern appears due to contrast between interference colors upon the rough or brilliant spangled appearance of an aventurin surface and the color produced by normal reflection of the light upon the smooth standard surface, when a viewer sees the roof far from same.

What is claimed is:

1. A slate of mortar cement having substantially a single color which reflects incident light comprising:
   an outer surface, a lower surface and a border;
   said outer surface of the slate having a first outer surface portion having one surface shape; and
   a second outer surface portion having a surface shape different from said first outer surface portion and at an inclined angle relative thereto for giving therebetween a color variation for reflected light, said second surface portion is inclined at an angle of from one to ten degrees from an upper end thereof on a level with said first surface portion toward a lower end of said first surface portion and ending substantially at a middle portion of said first surface portion.

2. The slate as claimed in claim 1 wherein said first outer surface portion of said outer surface is made rough and said second outer surface portion of said outer surface is made flat and smooth.

3. The slate as claimed in claim 1 wherein said second outer surface portion of said outer surface is made flat and smooth and said first outer surface portion of said outer surface is formed uneven by means of embossment.

4. The slate as claimed in claim 1 wherein said first outer surface portion of said outer surface comprises a standard surface portion having a constant thickness and said second outer surface portion of said outer surface comprises said inclined surface portion having a constantly changing thickness, said inclined surface portion being inclined from said upper end toward a lower end of the slate.

5. The slate as claimed in claim 4 wherein said inclined surface portion is formed uneven and said standard surface portion is made rough.

6. The slate as claimed in claim 4 wherein the inclined surface portion is formed smoothly over its entire surface and said standard surface portion is made rough over its entire surface.

7. The slate as claimed in claim 4 wherein said inclined surface portion is formed uneven and said standard surface portion is made to have a brilliant spangled appearance of aventurin.

8. The slate as claimed in claim 4 wherein the inclined surface portion is formed smoothly over its entire surface and said standard surface portion is made to have a brilliant spangled appearance of aventurin over its entire surface.

9. The slate as claimed in claim 1 wherein said first outer surface portion of said outer surface is made to have a brilliant spangled appearance of aventurin and said second outer surface portion of said outer surface is made flat and smooth.

10. The slate as claimed in claim 1 wherein the slope of the incline is about six degrees.

* * * * *